US007563132B2

(12) United States Patent
Ting

(10) Patent No.: US 7,563,132 B2
(45) Date of Patent: Jul. 21, 2009

(54) STACKED CARD CONNECTOR

(75) Inventor: Chien-Jen Ting, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,770

(22) Filed: Jun. 30, 2008

(65) Prior Publication Data

US 2009/0011653 A1 Jan. 8, 2009

(30) Foreign Application Priority Data

Jul. 2, 2007 (TW) ..... 96123944 A

(51) Int. Cl.
*H01R 13/60* (2006.01)

(52) U.S. Cl. ..... 439/541.5; 439/64; 439/630

(58) Field of Classification Search ..... 439/541.5, 439/64, 630

See application file for complete search history.

(56) References Cited

U.S. PATENT DOCUMENTS 5,085,590 A * 2/1992 Galloway ..... 439/95
5,795,184 A * 8/1998 Pan et al. ..... 439/541.5
6,146,193 A * 11/2000 Yu ..... 439/541.5
6,234,809 B1 * 5/2001 Futatsugi ..... 439/64
6,600,865 B2 * 7/2003 Hwang ..... 385/134
6,736,671 B2 * 5/2004 Lee ..... 439/541.5
6,736,672 B1 * 5/2004 Tsai ..... 439/541.5
7,063,539 B2 6/2006 Ho et al.
7,086,906 B1 8/2006 Ting

* cited by examiner

*Primary Examiner*—Gary F. Paumen
(74) *Attorney, Agent, or Firm*—Wei Te Chung

(57) ABSTRACT

A stacked card connector (100) adaptor for receiving cards includes a first card connector (1), a second card connector (2) under the first card connector and a converting plate (3) assembled on the second card connector. The first card connector includes a plurality of first terminals (13) with a vertical portion (132). The second card connector includes a plurality of second terminals (23) with a tail portion (232). The converting plate includes a plurality third terminals (32) with a contacting part (326). The distance between two adjacent vertical portions is equal with the distance between two adjacent tail portions, and integer times of the distance between two adjacent contacting parts. The vertical portions and the tail portions electrically engaging with corresponding contacting parts.

12 Claims, 6 Drawing Sheets

STACKED CARD CONNECTOR

BACKGROUND OF THE INVENTION

1. Field of the Invention

The present invention relates to a card connector to be used in a personal computer or the like for connecting and disconnecting a card to the personal computer. Here, the card generally refers to a memory card such as personal computer (PC) card or the like.

2. Description of Prior Arts

Modern times, the PC card is always used as an external equipment for increase the storage of the electrical consumer products, like Mobile phone, Digital camera, etc. The electrical card connector is used for electrically connecting the PC card and the electrical consumer products. Specially, a card connector is disclosed by the prior art, which comprises a plurality of card connectors stacked with each other to save the space of the electrical products. Meantime, for improving the quality of signals transmitting, some of stacked card connector use an electrical converting plate to electrical connect with a printed circuit board (PCB).

Said stacked card connector comprises different terminals mating with corresponding holes of the converting plate, and the converting plate is soldered to corresponding circuit on the PCB. However, during assembly, the terminals should be inserted into the holes of the converting plate exactly. Considering the size of the card connector and the converting, the process of inserting is very difficult and easily mismating.

Therefore, we need an improved stacked card connector to solve these problems.

SUMMARY OF THE INVENTION

An object, therefore, of the invention is to provide a stacked card connector, which is easily mating with a converting plate.

In the exemplary embodiment of the invention, a stacked card connector adaptor for receiving cards includes a first card connector, a second card connector under the first card connector and a converting plate assembled on the second card connector. The first card connector includes a plurality of first terminals with a vertical portion. The second card connector includes a plurality of second terminals with a tail portion. The converting plate includes a plurality third terminals with a contacting part. The distance between two adjacent vertical portions is equal with the distance between two adjacent tail portions, and integer times of the distance between two adjacent contacting parts. The vertical portions and the tail portions electrically engaging with corresponding contacting parts.

Other objects, advantages and novel features of the invention will become more apparent from the following detailed description of the present embodiment when taken in conjunction with the accompanying drawings.

DETAILED DESCRIPTION OF THE PREFERRED EMBODIMENT

An embodiment of the present invention will be described with reference to FIG. 1 through FIG. 6.

Figure 1:
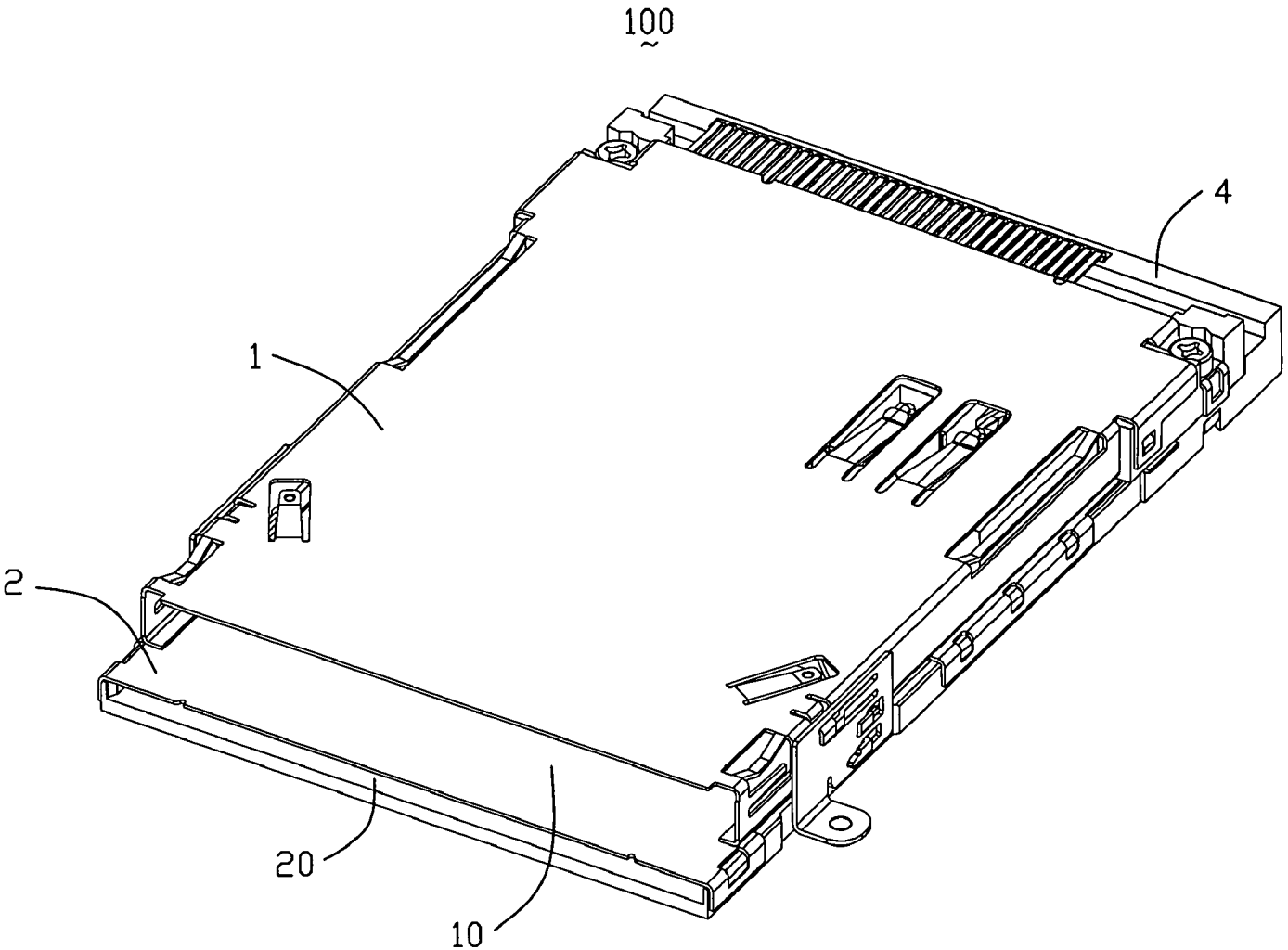
FIG. 1 is a perspective view of a stacked card connector of present invention.

In FIG. 1, a stacked card connector 100 of present invention comprises a first connector 1, a second connector 2 mounted under the first connector 1, a converting plate 3 mating with the first and the second connector 1, 2 and a retaining member 4.

Figure 2:
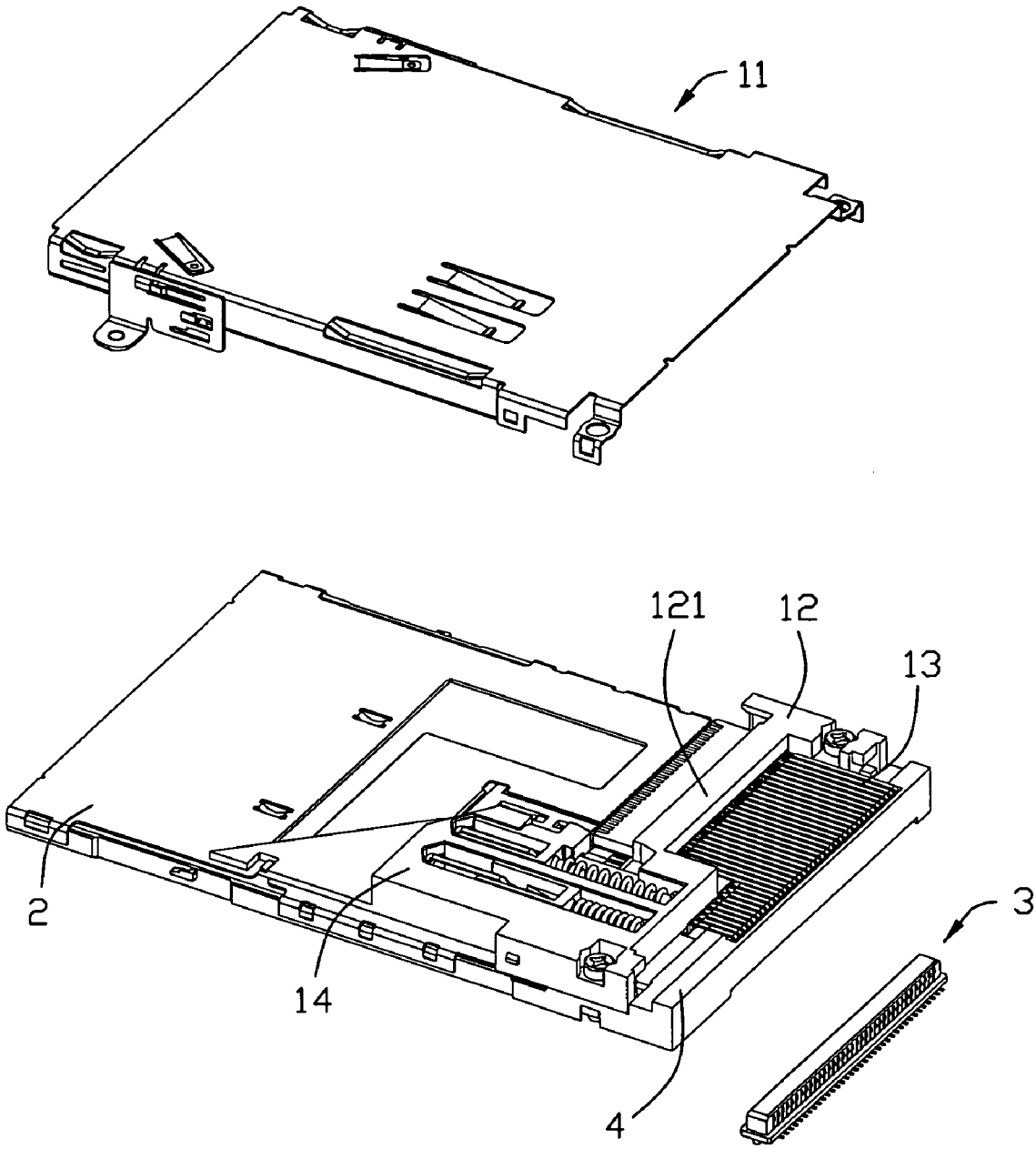
FIG. 2 is a partially exploded view of the stacked card connector of present invention as shown in FIG. 1.

Referring to FIG. 1 to FIG. 2, the first connector 1 is formed in an approximately longitudinal shape, and comprises a first shell 11 in a rectangular shape, and a first insulating housing 12 receiving a plurality of first terminals 13. The first shell 11 defining a first receiving space 10 and a first opening (not labeled) for card inserting, comprises a body plate 111 and a pair of side walls 112 extending downwardly from the body plate 111. The first insulating housing 12 comprises longitudinal base 121 and a base seat 14 extending from a end of the base 121. The first shell 11 connecting with the base 121 of the first insulating housing 12 opposite to the opening. The base seat 14 comprises a triangular guiding block (not labeled). The first terminals 13 partially received in the base 121, comprises a horizontal portion 131 and a vertical portion 132 extending downwardly from an end of the horizontal portion 131. The horizontal portion 131 is retained in the base 121 of the first insulating housing 12.

The second connector 2 comprises a second insulating housing 22, a second shell 21 covering on the second insulating housing 22 and a plurality of terminals 23 received in the second insulating housing 22. The second shell 21 defines a second receiving space 20 adaptor for receiving a second card. Each second terminal 23 comprises a contacting portion (not labeled), a vertical tail portion 232 beyond the second insulating housing 22 and a horizontally portion 231 connecting the contacting portion and the tail portion 232. The tail portion 232 vertically extends from a end of the connecting portion 231. The vertical portions 132 of the first terminals 13 and the tail portions 232 of the second terminals 23 are arranged in a line in a lateral direction.

Figure 3:
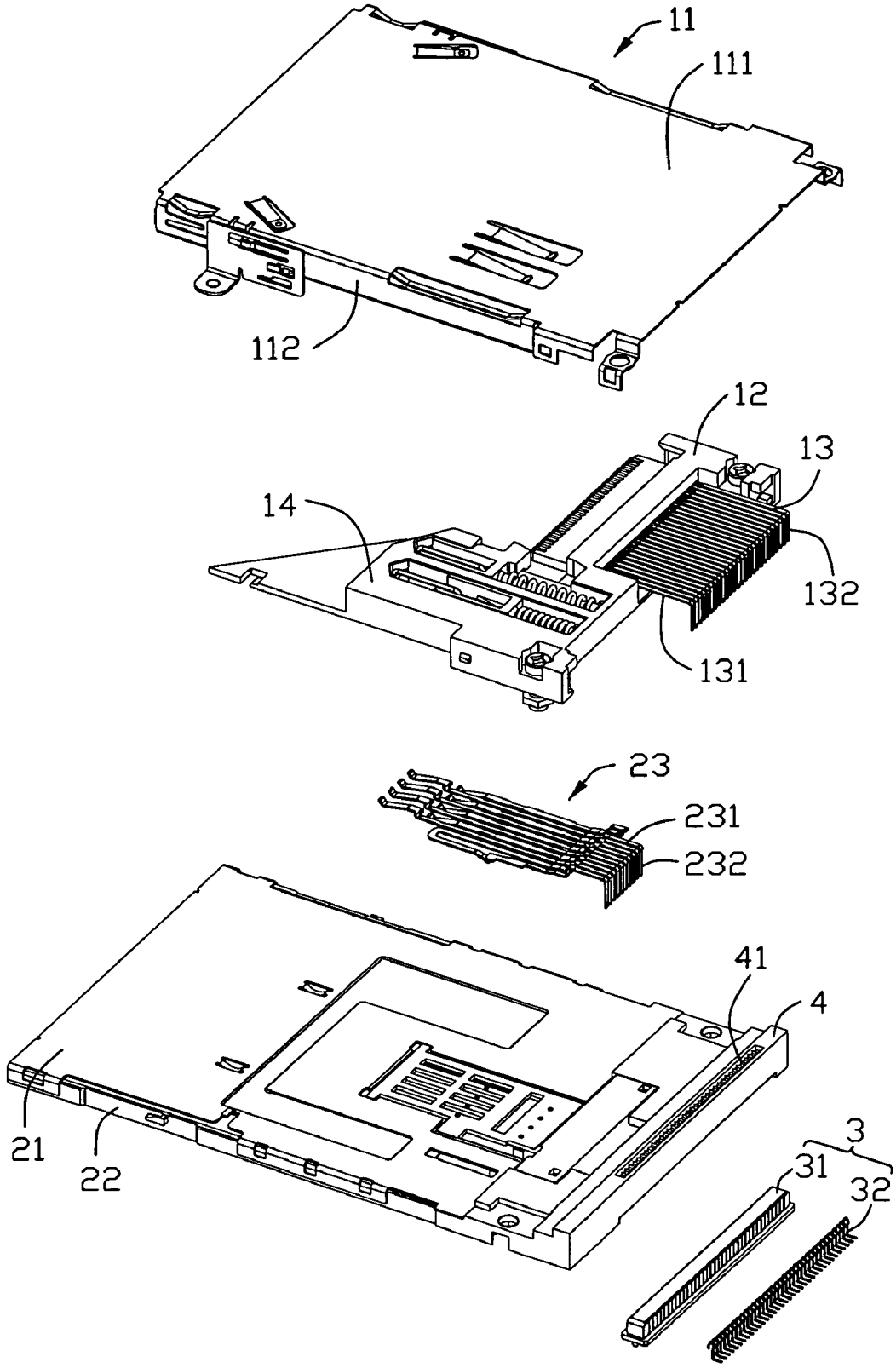
FIG. 3 is an exploded view of the stacked card connector of present invention as shown in FIG. 1.
Figure 4:
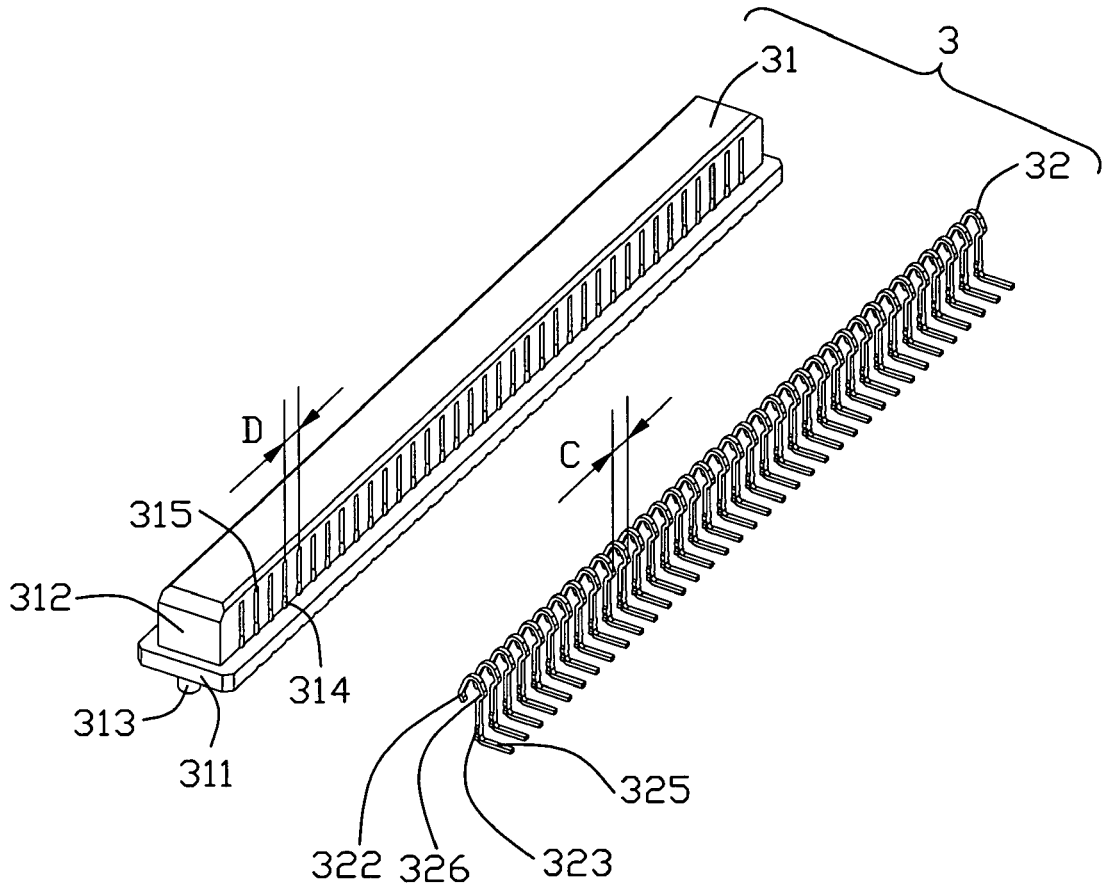
FIG. 4 is an exploded view of a converting plate of the stacked card connector of present invention as shown in FIG. 1.
Figure 5:
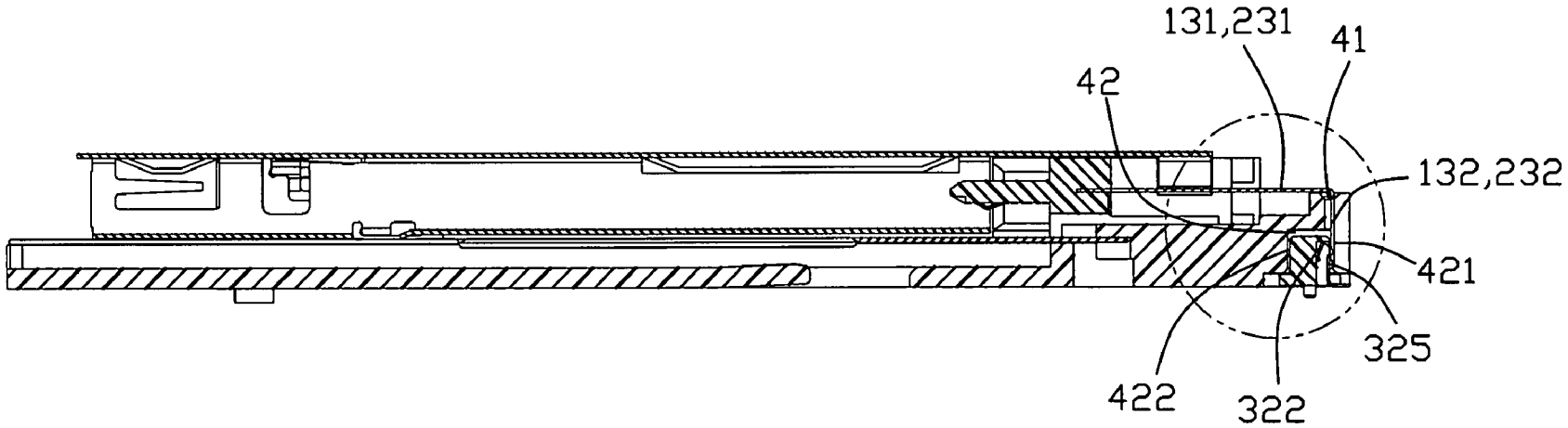
FIG. 5 is a cross-section view of the stacked card connector of present invention as shown in FIG. 1.
Figure 6:
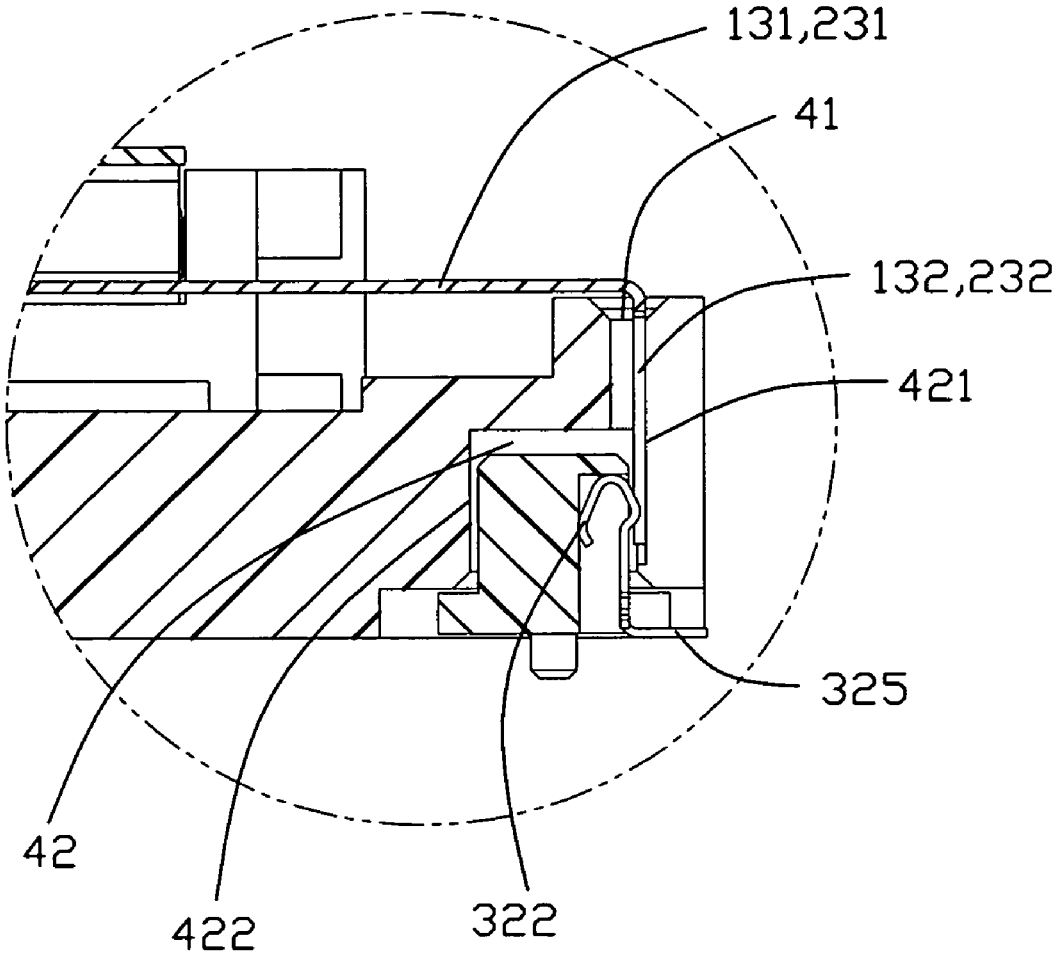
FIG. 6 is an enlarged view of the part labeled in FIG. 5.

As shown in FIG. 2, FIG. 3 and FIG. 6, the second insulating housing 22 forms a retaining member 4 at a end thereof. The retaining member 4 defines a plurality of vertical slots 41 arranged in a line in the lateral direction. The retaining member 4 further comprises a receiving cavity 42 communicating with the vertical slots 41. The vertical slots 41 are provided for corresponding first terminals 13 and the second terminals 23 passing through. The converting plate 3 is received in the receiving cavity 43. The retaining member 4 comprises a front inside surface 421 communicating with the vertical slots 41 and a rear inside surface 422. The vertical portion 132 of the first terminal 13 and the tail portion 232 of the second terminal 23 pass through the vertical slot 41 to attach the front inside surface 421. In this embodiment, the retaining member 4 is integral with the second insulating housing 22. Certainly, the retaining member 4 is capable of separating from the second insulating housing 22.

Referring to FIG. 3-FIG. 6, the longitudinal converting plate 3 comprises a longitudinal body 31, a plurality of third terminals 32. The body 31 comprises a main portion 311, a receiving portion 312 extending upwardly from the main portion 311 and a positioning portion 313 extending downwardly from the main portion 311 to positioning the converting plate 3 on a printed circuit board (PCB). The receiving portion 312 defines a plurality of terminal cavities 314 at a lateral side thereof for receiving the third terminals 32. Each terminal cavity 314 defines a vertical cutout 315 at the lateral surface of the receiving portion 312. A distance between the adjacent two cutouts 315 is certain, and defined as a distance D. Each third terminal 32 comprises a vertically extending retaining part 323, a resilient and curved contacting part 326 bent from the top end of the retaining part 323, a soldering part 325 extending horizontally from the bottom end of the retaining part 323. Each curved contacting part 326 forms free end 322. The third terminals 32 are assembled into corresponding terminal cavities 314 in an up-to-down direction. The retaining parts 323 are retained in the terminal cavities 314, the free ends 322 of the contacting parts 326 are received in the terminal cavities 314 and face to the inside of the terminal cavities 314, the contacting parts 326 are partially beyond the lateral surface of the receiving portion 312 from the cutouts and the soldering parts 325 are beyond the bottom surface of the main portion 311. The converting plate 3 mates with the retaining member 4 with the receiving portion 31 received in the receiving cavities. Correspondingly, the contacting parts 326 of the third terminals 32 electrically connecting with the vertical portion 132 of the first terminals 13 and the tail portions 232 of the second terminals 23 at the front inside surface 421 of the receiving cavity 43. The distance between the adjacent two contacting parts 326 is defined as a distance C. When each terminal cavity 314 receives a third terminal 32, the distance C is equal with the distance D. When the third terminals 32 is alternatively received in the terminal cavities 314, the distance C is twice than the distance D. As this rule, the distance C is integer times of the distance D.

In this embodiment, the first card is a type of Express card, and the second card is a Smart card. So, the first terminals 13 has a different signal transmitting speed with the second terminals 23. However, a distance of the adjacent two vertical portions 132 of the first terminals 13 is equal with a distance between the adjacent two tail portions 232 of the second terminals 23. Meantime, the distance of the adjacent two vertical portions 132 and the distance between the adjacent two tail portions 232 is equal with or integer times of the distance C.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A stacked card connector adaptor for receiving cards, comprising:

a first card connector comprising a plurality of first terminals, the first terminal comprising a vertical portion;

a second card connector positioned under the first card connector and comprising a plurality of second terminals, the second terminal comprising a tail portion; and a converting plate assembled on the second card connector and comprising a plurality of third terminals, the third terminal comprising a contacting part; wherein a distance between two adjacent vertical portions of the first terminals is equal to a distance between two adjacent tail portions of the second terminals, and the vertical portions of the first terminals and the tail portions of the second terminals electrically engage with corresponding contacting parts of the third terminals.

2. The stacked card connector as claimed in claim 1, further comprising a retaining member on the second card connector defining a receiving cavity, said converting plate being received in the receiving cavity.

3. The stacked card connector as claimed in claim 2, wherein the retaining member defines a plurality of vertical slots communicating with the receiving cavity, said vertical portions of the first terminals and said tail portions of the second terminals passing through corresponding vertical slots into the receiving cavity.

4. The stacked card connector as claimed in claim 1, wherein the converting plate comprises a main portion and a receiving portion extending from the main portion, the receiving portion is received in said receiving cavity of the retaining member.

5. The stacked card connector as claimed in claim 4, wherein the third terminal comprises a retaining part retaining in the receiving portion, a soldering part extending from an end of the retaining part and said contacting part extending from the other end of the retaining part opposite to the soldering part and partially beyond a lateral surface of the receiving portion.

6. The stacked card connector as claimed in claim 1, wherein the first terminals have a different signal transmitting speed than the second terminals.

7. The stacked card connector as claimed in claim 1, wherein the first card connector comprises a first shell covering on the first insulating housing, the first shell defining a first receiving space.

8. The stacked card connector as claimed in claim 7, wherein the first insulating housing forms a triangular guiding block in the first receiving space.

9. The stacked card connector as claimed in claim 1, wherein the second card connector comprises a terminal module received in the second insulating housing, and wherein said second terminals are partially received in the terminal module.

10. A stacked connector comprising:

an upper connector including an upper housing equipped with a plurality of upper contacts;

a lower connector stacked with the upper connector and including a lower housing equipped with a plurality of lower contacts;

vertical portions of the upper contacts and tail portions the lower contacts extending in a vertical direction under a condition that a pitch among the vertical portions of the upper contacts is equal to that among the tail portions of the lower contacts;

a converting plate positioned essentially at a same level with a main portion of the lower housing and equipped with a plurality of connection contacts with a pitch equal to that of the vertical portions of said upper contacts and the tail portions of said lower contacts.

11. The electrical connector assembly as claimed in claim 10, wherein all said connection contacts are arranged in one row.

12. The electrical connector assembly as claimed in claim 11, wherein the converting plate is essentially embedded within a rear portion of the lower housing.

* * * * *